US005471371A

United States Patent [19]

Koppolu et al.

[11] Patent Number: 5,471,371

[45] Date of Patent: Nov. 28, 1995

[54] HIGH EFFICIENCY ILLUMINATOR

[75] Inventors: Prasad M. Koppolu, Troy; Amir Fallahi, Holly; Jeyachandrabose Chinniah, Troy, all of Mich.

[73] Assignee: Ford Motor Company, Dearborn, Mich.

[21] Appl. No.: 2,006

[22] Filed: Jan. 8, 1993

[51] Int. Cl.[6] ..... F21V 7/04

[52] U.S. Cl. ..... 362/32; 362/307; 362/328; 362/347; 362/800

[58] Field of Search ..... 362/241, 245, 362/247, 297, 328, 347, 800, 32, 307

[56] References Cited

U.S. PATENT DOCUMENTS

| | | | |
|---|---|---|---|
| 1,419,482 | 6/1922 | Wood . | |
| 1,589,664 | 6/1926 | Ryland . | |
| 1,815,751 | 7/1931 | Whalen . | |
| 1,995,012 | 3/1935 | Rivier . | |
| 2,198,014 | 4/1940 | Ott . | |
| 2,229,693 | 1/1941 | Dietrich . | |
| 3,900,727 | 8/1975 | Hutz . | |
| 4,241,382 | 12/1980 | Daniel . | |
| 4,389,698 | 6/1983 | Cibie . | |
| 4,408,266 | 10/1983 | Sclippa . | |
| 4,417,300 | 11/1983 | Bodmer . | |
| 4,432,039 | 2/1984 | Cibie . | |
| 4,456,948 | 6/1984 | Brun . | |
| 4,463,410 | 7/1984 | Mori | 362/328 |
| 4,494,176 | 1/1985 | Sands et al. . | |
| 4,517,631 | 5/1985 | Mullins | 362/297 |
| 4,523,262 | 6/1985 | Shinkai . | |
| 4,536,834 | 8/1985 | Sands et al. . | |
| 4,556,928 | 12/1985 | Tysoe . | |
| 4,644,455 | 2/1987 | Inglis et al. . | |
| 4,654,758 | 3/1987 | Szekacs . | |
| 4,740,871 | 4/1988 | Dilouya . | |
| 4,755,918 | 7/1988 | Pristash et al. . | |
| 4,794,493 | 12/1988 | Luciani . | |
| 4,803,601 | 2/1989 | Collot et al. . | |
| 4,811,172 | 3/1989 | Davenport et al. . | |
| 4,868,718 | 9/1989 | Davenport et al. . | |
| 4,868,723 | 9/1989 | Kobayashi . | |
| 4,883,333 | 11/1989 | Yanez . | |
| 4,916,592 | 4/1990 | Sultan et al. . | |
| 4,929,866 | 5/1990 | Murata et al. | 362/800 |
| 4,956,759 | 9/1990 | Goldenberg et al. . | |
| 5,001,609 | 3/1991 | Gardner et al. . | |
| 5,058,985 | 10/1991 | Davenport et al. . | |
| 5,128,848 | 7/1992 | Enders et al. | 362/297 |
| 5,174,649 | 12/1992 | Alston | 362/800 |
| 5,241,457 | 8/1993 | Sasajima et al. | 362/800 |
| 5,278,731 | 1/1994 | Davenport et al. | 362/32 |
| 5,321,586 | 6/1994 | Hege et al. | 362/32 |

FOREIGN PATENT DOCUMENTS

| | | |
|---|---|---|
| 2710553 | 9/1978 | Germany . |

*Primary Examiner*—Carroll B. Dority
*Attorney, Agent, or Firm*—Kevin G. Mierzwa; Roger L. May

[57] ABSTRACT

An illuminator for use with a light source having a light distribution pattern within a solid angle of $2\pi$ steradians. The light source comprises or includes a series of LED's or light pipes positioned at or near a focal point of a reflective surface and inclined at an angle to a focal axis of the reflective surface such that all of the light from the light source is collected and distributed by the reflective surface. Whereby the reflective surface is optimized to confine the light output only to the required photometric zones thus maximizing the efficiency of the illuminator.

17 Claims, 4 Drawing Sheets

Fig-3
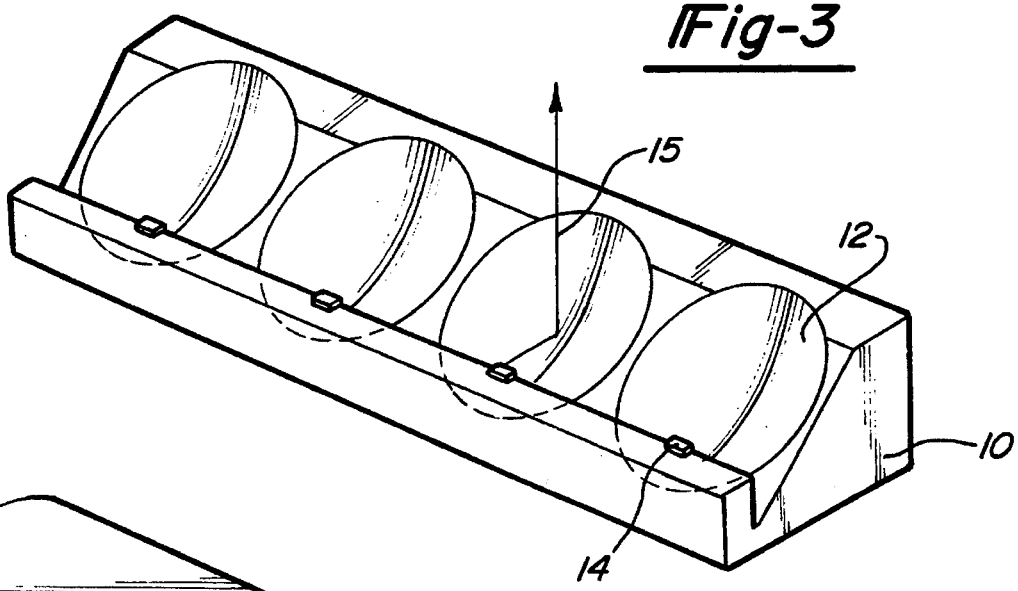
Fig-6
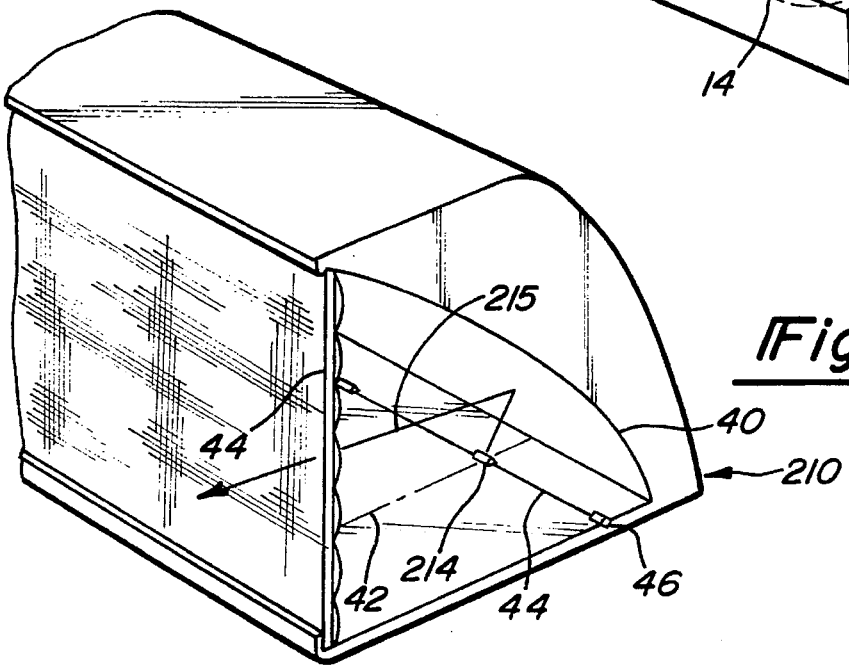
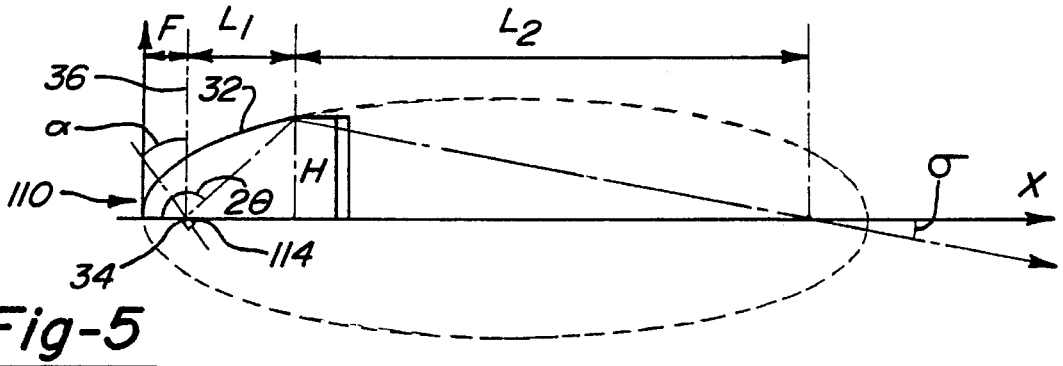
Fig-5

HIGH EFFICIENCY ILLUMINATOR

BACKGROUND OF THE INVENTION

1. Field of the Invention

The present invention relates generally to a light transmission system for use in vehicle lighting systems, specifically a high efficiency illuminator for use with a light source.

2. Description of the Related Art

Conventional vehicle lighting systems typically utilize a bulb and reflector combination. In a bulb and reflector combination, a filament of the bulb is placed at or near a focal point of the reflector. The focal point of a reflector is that point at which parallel rays of light meet after being reflected by a reflective surface. Conversely, light rays emanating from the focal point are reflected as parallel rays of light. Energy supplied to the filament radiates as light over a $4\pi$ steradian angle. A portion of the radiated light is collected by the reflector and reflected outward. The outwardly reflected light combines with light radiating outward directly from the filament to form a light beam. A lens is used to shape the light beam into a specified pattern as established by vehicle lighting standards.

Bulb and reflector combination have several disadvantages, including aerodynamic and aesthetic styling, e.g., the depth of the reflector along its focal axis and the dimensions of the reflector in directions perpendicular to the focal axis have greatly limited attempts at streamlining the vehicle. The heat generated during bulb operation must be dissipated and thus becomes a factor to consider when designing a vehicle lighting system. Also, bulbs burnout and must be replaced. Placing a bulb in a difficult to reach position creates maintenance problems and reduces design freedoms.

With the advent of light guides such as fiber optics, the ability to use a remote light source and a light guide to transfer light generated at a remote light source to a distant location became available. Other light sources such as a light emitting diode (LED) have also been used to replace a standard filament bulb. Light emitting diodes are used because they are less costly and emit a greater amount of light than typical filament bulb systems.

A lighting system showing or utilizing a LED is disclosed in U.S. Pat. No. 5,001,609. This patent discloses an LED illumination lamp producing a bright output over a preselected viewing angle having two focusing stages for concentrating the light emitted by the diode into a final desired viewing angle. A substantial portion of the usable light is light rays emanating directly from the light source. The device reflects only a certain portion of the light emanating from the diode, which limits the ability of the device to confine the light into the required photometric zones.

While this approach may have some limited use, it is desired to have an illuminator which collects and distributes substantially all of the light emanating from a light source thereby minimizing the number of light sources, LEDs or light guides necessary to develop the required lumens. Additionally, confining the light output exclusively to the required photometric zones maximizes illuminator efficiency and results in an optimum illuminator in terms of size and efficiency.

SUMMARY OF THE INVENTION

Accordingly, the present is a unique lighting system for use in vehicle illumination. In general, the illuminator includes a light source and a means for collecting and distributing substantially all of the light emitted from the light source. The means for collecting and distributing substantially all of the emitted light includes a paraboloidal or a ellipsoidal shaped reflector including a focal point and a focal axis. The light source is positioned at the focal point of the reflector and is inclined with respect to the focal axis.

One advantage of the present invention is that substantially all of the emitted light is collected and dispersed. By collecting substantially all of the light emitted by the light source, no direct light from the source is used to form the desired beam pattern thus confining the light in the required photometric zones. Further advantages include minimizing the number of light sources utilized and providing a novel and efficient illumination source for producing light suitable for vehicle illumination.

BRIEF DESCRIPTION OF THE DRAWINGS

FIG. 3 is a perspective view of the illuminator of FIG. 1.

FIG. 5 is a schematic side view of a first alternative embodiment of FIG. 1 using an ellipsoidal reflector.

FIG. 6 is a second alternative embodiment of the illuminator of FIG. 1.

DESCRIPTION OF THE PREFERRED EMBODIMENT(S)

Figure 1:
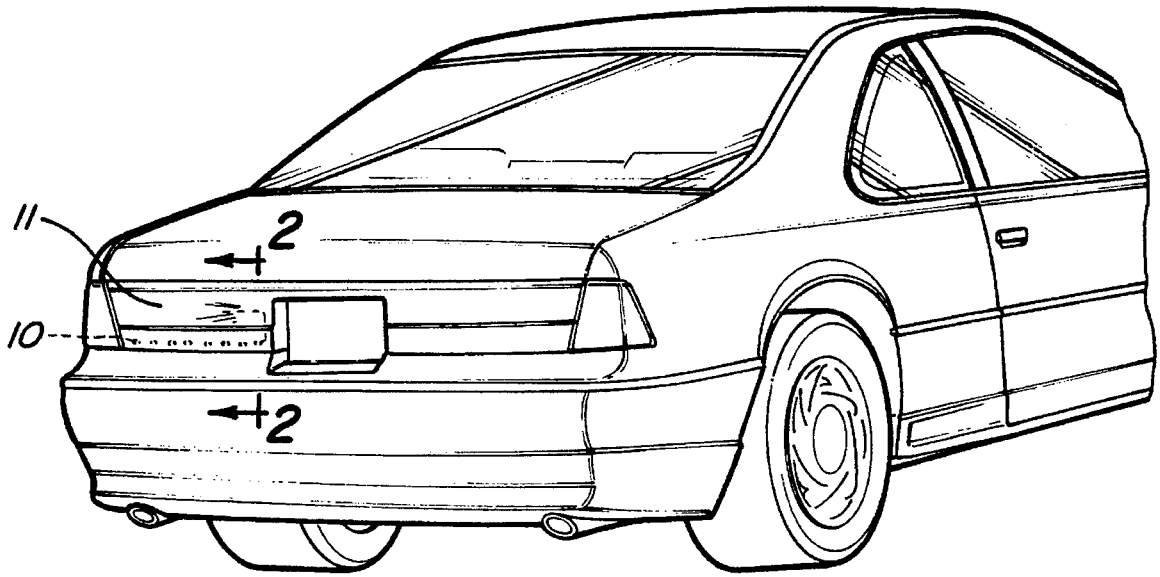
FIG. 1 is a perspective view of an illuminator according to the present invention, illustrated as a tail light on a vehicle.

Referring to the drawings and more particularly to FIG. 1 thereof, an illuminator 10 is shown in use as a part of a vehicle taillight 11 of a motor vehicle.

As illustrated in FIGS. 2, 3 and 7A–D, an illuminator 10, according to the present invention, includes a semi-paraboloidal reflector 12 and a light source 14. The light source 14 such as a light emitting diode (LED) or light guide transmitting light from a remote light source to a NIO (non-imagining optics) concentrator, is positioned at the focal point 16 of the semi-paraboloidal reflector 12 and inclined at an angle (α) with respect to the focal axis 18 of the semi-paraboloidal reflector 12. It should be appreciated that non-imaging optics do not require that the emitting surface be imaged onto the viewing plane and thus provides greater design freedom.

The inclination angle (α) of the light source 14 is dependent upon the radiation pattern or cone angle 2θ developed by a particular light source. Typical cone angles range from 2θ=70° for a light guide and a 2θ=135° for a light emitting diode. For a light source 14 emitting a cone of light having a cone angle of 2θ, the inclination angle (α) is 90–θ from the vertical and towards the vertex 20 of the semi-paraboloidal reflector 12. It should be appreciated that the illuminator 10 collects and distributes substantially all the light emitted by the light source 14.

Figure 2:
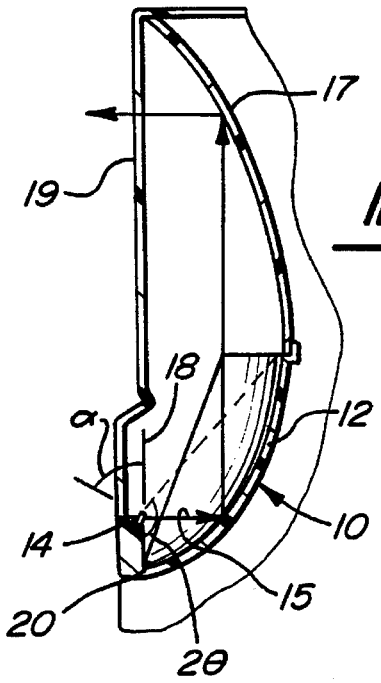
FIG. 2 is a sectional view taken along line 2— 2 of FIG. 1.

As shown in FIG. 2, a light ray 15 is emitted from the light source 14 and strikes the semi-paraboloidal reflector 12. The light ray 15 is reflected from the semi-paraboloidal reflector 12 in a direction parallel to the focal axis 18. The light ray 15 then strikes a secondary reflector 17 which redirects the light ray 15 outward as useable light. A lens 19 may be used to further shape or direct the light ray 15 as necessary. It should be appreciated that each light ray reflected by the semi-paraboloidal reflector 12 is reflected in a direction parallel the focal axis 18 of the reflector 12.

The direction of each ray 15 reflected from the secondary reflector 17 is controlled by the shape or configuration of the secondary reflector 17, whereby the secondary reflector 17 and lens 19 (when necessary) combine to direct substantially all of the light emitted by the light source 14 into the required photometric zones. As shown in FIG. 3, a plurality of semi-paraboloidal reflective surfaces 12 each having a separate light source 14 may be used to form a light beam.

Figure 4:
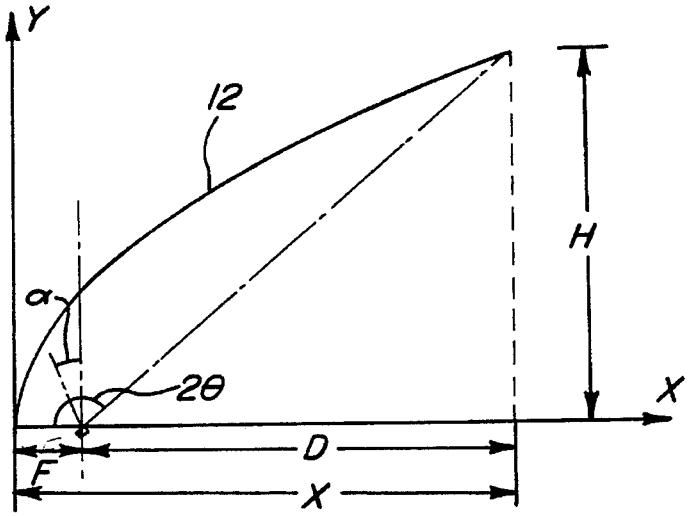
FIG. 4 is a schematic side view of the illuminator of FIG. 3.

Referring now to FIG. 4, a schematic of a semi-paraboloidal reflector 12 having a given illuminator height (H) is shown. Given the desired illuminator height (H), the focal length (F) and depth (D) of the semi-paraboloidal reflector 12 can be determined. It should be appreciated that a change in the cone angle 2θ of the light source results in a change in focal point position for a constant height (H) of the illuminator 10. The width of the semi-paraboloidal reflector 12 is obtained by solving for the intersection of the semi-paraboloidal reflector 12 and the light cone 24 emitted by the light source 14 (see FIG. 7E). It will be seen that substantially all the light emitted by each light source 14 having a cone angle 2θ less than 2π steradians will be collected and distributed by the semi-paraboloidal reflector 12.

For a given height (H) of the illuminator 10, and a light source 14 having a cone angle 2θ, wherein $\pi/2<2\theta<\pi$, the focal length (F) and the depth (D) of the paraboloidal reflector 12 are calculated by the following steps:

$$\mathrm{TAN}(2\pi-2\Theta)=\frac{H}{X-F}$$

and $$X-F=\frac{H}{\mathrm{TAN}(2\pi-2\Theta)}$$

The equation for a parabola having an origin at vertex is $$X=\frac{Y^2}{4F}$$

Substituting for X above $$\frac{Y^2}{4F}-F=\frac{H}{\mathrm{TAN}('90-2\Theta)}$$

For Y=H $$\frac{H^2}{4F}-F=\frac{H}{-\mathrm{TAN}\,2\Theta}$$

and $$(4\ \mathrm{TAN}\ 2\Theta)\ F^2-(4H)F-H^2\ \mathrm{TAN}\ 2\Theta=0$$

therefore $$F=\frac{4H\pm\sqrt{16H^2+16H^2\ \mathrm{TAN}^2\ 2\Theta)}}{8\ \mathrm{TAN}\ 2\Theta}$$

and $$D=\frac{H}{\mathrm{TAN}\ 2\Theta}$$

Using the foregoing formulas and a known illuminator height (H) and light source cone angle 2θ, the configuration of the semi-paraboloidal section 12 may be calculated.

Figure 7A:
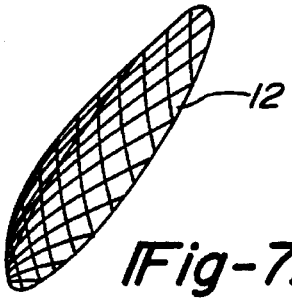
FIG. 7A is a perspective view of a semi-paraboloidal shaped reflector surface.
Figure 7B:
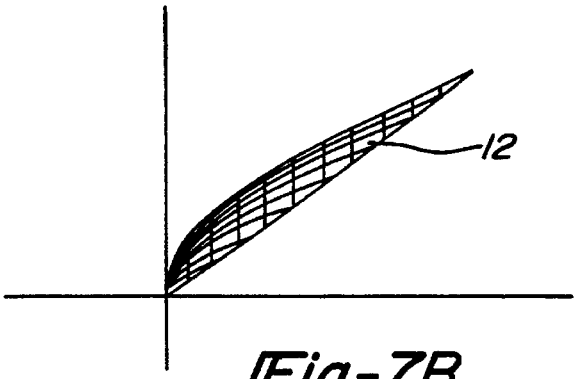
FIG. 7B is a side view of the semi-paraboloidal shaped reflector of FIG. 7A.
Figure 7C:
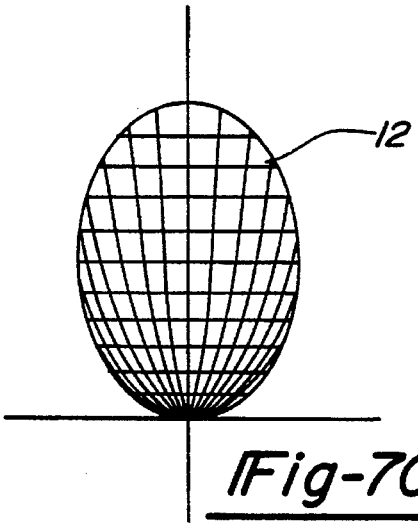
FIG. 7C is a top view of the semi-paraboloidal shaped reflector of FIG. 7A.
Figure 7D:
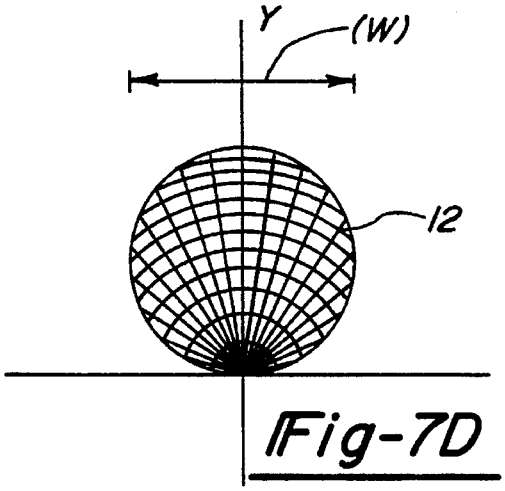
FIG. 7D is a front view of the semi-paraboloidal shaped reflector of FIG. 7A.
Figure 7E:
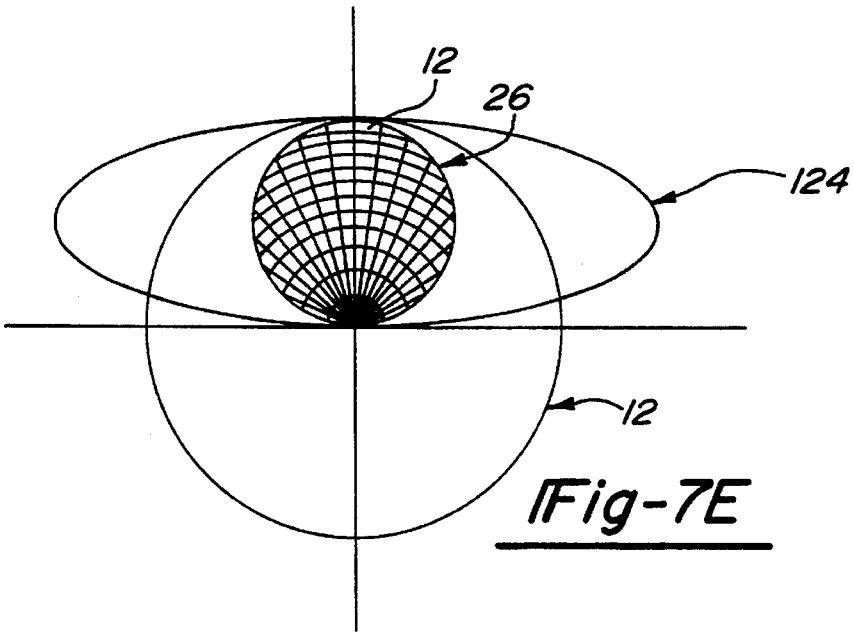
FIG. 7E is a front view showing the intersection of a light cone and a semi-paraboloidal surface.
Figure 8A:
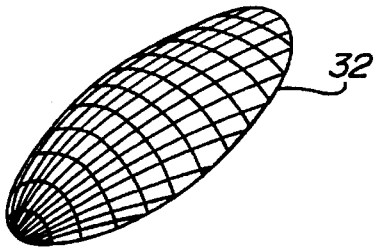
FIG. 8A is a perspective view of a semi-ellipsoidal shaped reflector surface.
Figure 8B:
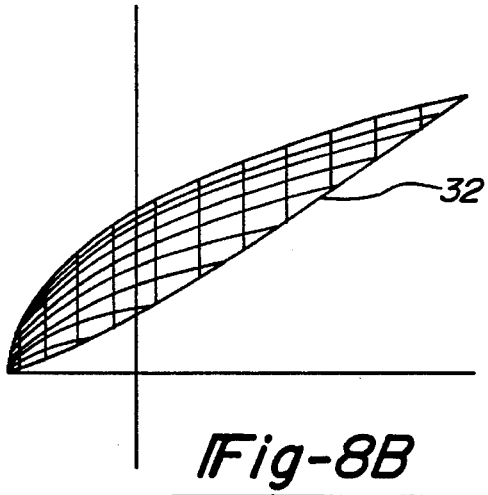
FIG. 8B is a side view of the semi-ellipsoidal shaped reflector of FIG. 8A.
Figure 8C:
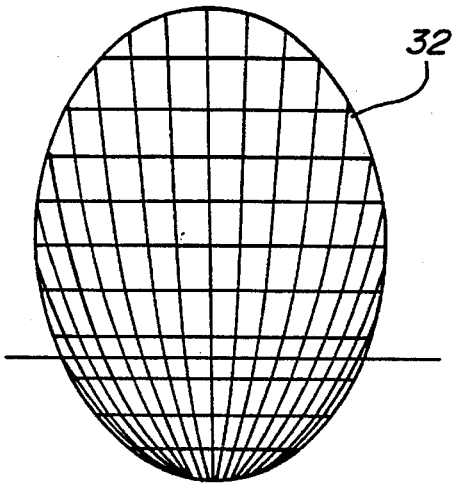
FIG. 8C is a top view of the semi-ellipsoidal shaped reflector of FIG. 8A.
Figure 8D:
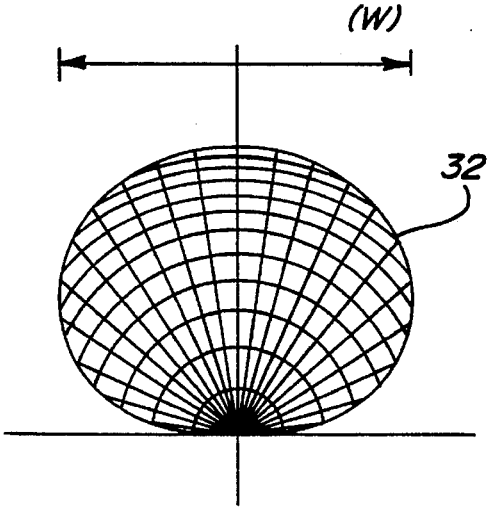
FIG. 8D is a front view of the semi-ellipsoidal shaped reflector of FIG. 8A.
Figure 8E:
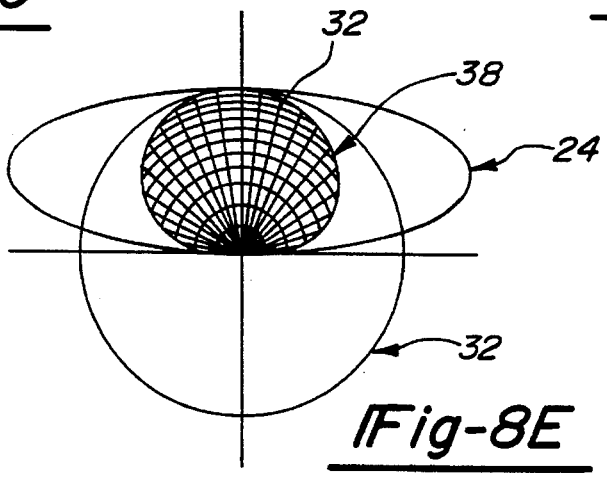
FIG. 8E is a front view showing the intersection of a light cone and a semi-ellipsoidal surface.

Turning now to FIG. 7E, the intersection 26 of the semi-paraboloidal reflector 12 and the light cone 24 emitted by the light source 14 is shown. The cone angle 2θ of the light source 14 prevents the light source 14 from illuminating the entire semi-paraboloidal reflector 12. It should be appreciated that the width (W) (see FIG. 7D) of the semi-paraboloidal reflector 12 is limited by the area of the semi-paraboloidal reflector 12 which is illuminated by the light source 14. To obtain the width (W) of the semi-paraboloidal reflector 12, the intersection of the light cone 24 and the semi-paraboloidal reflector 12 must be determined. The semi-paraboloidal reflector 12 is defined by the equation $$X=\frac{Y^2+Z^2}{4F}$$

and the light cone is defined by the equation $$[(X-F)\sin\theta+Y\cos\theta]^2+Z^2=[-(X-F)\cos\theta+Y\sin\theta]^2\tan^2\theta$$

Solving for the intersection 26 of these two equations gives the width of the semi-paraboloidal reflector 12. It should be appreciated that an illuminator having a semi-paraboloidal reflector 12 designed according to the foregoing steps will collect and collimate substantially all of the light emanating from a light source 14.

Referring now to FIGS. 5 and 8A–E, an illuminator 110 according to an alternative embodiment of the eliminator 10 of the present invention is shown. Like parts of the illuminator 110 have like reference numerals increased by one hundred (100). The illuminator 10 includes a semi-ellipsoidal reflector 32. The semi-ellipsoidal reflector 32 collects and distributes light from a light source 114 either left, right, up or down of the photometric field. Additionally the amount of spread (σ) can be controlled by varying dimensions of the ellipsoidal shape. As with the semi-paraboloidal reflector 12, the light source 114 is placed at the focal point 34 of the semi-ellipsoidal reflector 32 and inclined at an angle (α) with respect to the focal axis 36. Once again, the inclination angle (α) is dependent upon the radiation pattern and the cone angle 2θ of the particular light source 114 used. For an illuminator 110 of a given height (H) and a desired spread angle (σ) the focal length (F) of an ellipsoid and the lengths $L_1$, $L_2$ may be calculated as follows:

$$L_1 = \frac{H}{\text{TAN } 2\Theta}$$

$$L_2 = h \text{ COT } \sigma$$

$$F = \sqrt{L_1^2 + H^2} + \sqrt{L_2^2 + H^2} - L_1 - L_2$$

Wherein the depth (D) of the illuminator 10 is:

$$D = F + L_1$$

It should be appreciated that an illuminator 10 designed in accordance with the foregoing steps will collect and distribute substantially all of the light emanating from the light source 114. The width (W) (see FIG. 8D) of the semi-ellipsoidal reflector 32 is determined by the intersection 38 of the light cone 124 with the semi-ellipsoidal reflector 32. It should be also appreciated that a plurality of semi-ellipsoidal reflector 32 may be combined to develop a specific beam pattern.

Referring now to FIG. 6, an illuminator 210 according to a second alternative embodiment of the illuminator 10 present invention is shown. Like parts of the illuminator 210 have like reference numeral increased by a factor of two hundred (200). The illuminator 210 utilizes an elongated semi-paraboloidal cylinder 40 or a plurality of segmented semi-parabolic cylinders and a plurality of light sources 214 distributing light within a cone angle 2θ. As set forth previously, the light source 214 is either an LED or light guide having a tip, such as an NIO concentrator. The configuration of the semi-paraboloidal cylinder 40 is determined in accordance with the procedure previously set forth, such that placing the light source 214 on a focal axis 42, of the semi-paraboloidal cylinder 40 reflects light rays 215 from the semi-parabolic cylinder 40 in a vertically collimated but horizontally spread beam pattern. Moving the light source 214 along the focal axis 42, and closer to the vertex results in a vertical spread of the beam and conversely, moving the light source away from the vertex results in a shrinking or narrowing of the light beam. It should be appreciated that a neon tube may be used as a single light source rather than a plurality of individual light sources 214. Additionally, the semi-paraboloidal cylinder may be curved within the plane of an axis 44 extending through a focal point 46 and perpendicular to the focal axis 42 to concentrate or spread the light in the horizontal direction. Depending on the application, lens optics 44 may be used to further focus or direct the light beam.

It should be appreciated the illuminator collects and distributes substantially all the light rays emitted from the light source. The light may be distributed in variable intensity patterns resulting in a simpler to manufacture assemble and package lighting system. It should also be appreciated that since no direct light from the light sources is utilized the lens design can be optimized to eliminate light falling in unwanted zones.

What is claimed is:

1. An illuminator for use with a vehicle comprising:

a light source, said light source having a distribution pattern within a solid angle of 2π steradians; and a reflective surface for collecting and distributing substantially all of the light emitted from said light source, said reflective surface having a focal point and a focal axis wherein said light source is positioned near the focal point and inclined with respect to said focal axis such that the light collected and distributed by said reflective surface does not strike said light source.

2. An illuminator as set forth in claim 1 wherein said distribution pattern is a conical pattern having a cone angle of 2θ; and said light source is inclined with respect to an axis perpendicular said focal axis at an angle equal to 90°–θ.

3. An illuminator as set forth in claim 1 wherein said reflective surface includes a semi-paraboloidal shaped surface.

4. An illuminator as set forth in claim 1 wherein said reflective surface includes a semi-ellipsoidal shaped surface.

5. An illuminator as set forth in claim 1 wherein said reflective surface including an elongated semi-parabolic shaped channel.

6. An illuminator as set forth in claim 5 wherein said collected light is distributed in a predetermined beam pattern and the position of said light source with respect to the focal axis is variable and controls the predetermined beam pattern.

7. An illuminator as set forth in claim 5 wherein said elongated semi-parabolic shaped channel has an arcuate longitudinal axis.

8. An illuminator as set forth in claim 1 including a plurality of reflective surfaces and a plurality of light sources.

9. An illuminator as set forth in claim 1 wherein said light source includes a light guide transmitting light from a remote light source.

10. An illuminator as set forth in claim 1 wherein said light source includes a light emitting diode.

11. An illuminator as set forth in claim 1 including a lens for forming said distributed light into a desired beam pattern.

12. An illuminator for use with a vehicle comprising:

a reflective surface having a focal point and a focal axis;

a light source emitting light in a conical distribution pattern, positioned near the focal point and inclined with respect to said focal axis, said light source illuminating only said reflective surface so that said reflective surface collects and distributes substantially all of the light emitted from said light source; and said light source positioned such that the light collected and distributed by said reflective surface does not strike said light source.

13. A method of forming a light beam for use with a vehicle comprising, emitting light from a light source, said light source emitting light in a distribution pattern having a solid angle of less than 2π steradians;

collecting the light emitted from the light source on a reflective surface, said reflective surface having a focal point and a focal axis, wherein substantially all of the light emitted by said light source strikes said reflective surface;

distributing the light from said reflective surface in a predetermined specified beam pattern; and positioning said light source near the focal point such that the light distributed from the reflective surface does not strike the light source.

14. A method of forming a light beam as set forth in claim 13 including passing the light through a lens to form the light into said desired specified beam pattern.

15. A method of forming a light beam as set forth in claim 13 wherein the reflective surface includes a semi-paraboloidal surface of a configuration generated by the steps of selecting a required height of the light beam, selecting the distribution pattern of the light source; utilizing the required height of the light beam and the distribution pattern of the light source to calculate a focal point of the semi-paraboloidal surface and determining the distance between the focal point and a vertex of the semi-paraboloidal surface from which the shape of the semi-parabolodial surface can be determined.

16. A method of forming a light beam as set forth in claim 13 wherein the reflective surface includes a semi-ellipsoidal surface of a configuration generated by the steps of selecting a required height of the light beam, selecting the distribution pattern of the light source; determining a beam spread angle; and utilizing the required height of the light beam, the distribution pattern of the light source and the beam spread angle to calculate a focal point of the semi-ellipsoidal surface from which the shape of the semi-ellipsoidal surface call be determined.

17. A method of forming a light beam as set forth in claim 13 wherein the reflective surface includes an elongated surface having a semi-parabolic cross-section, the configuration of the semi-parabolic cross-section generated by the steps of selecting a required height of the light beam, selecting a distribution pattern of the light source; utilizing the required height of the light beam and the distribution pattern of the light source to calculate a focal point of the semi-parabolic cross-section surface and determining the distance between the focal point and a vertex of the semi-parabolic cross-section from which the shape of the semi-parabolic cross-section can be determined.

* * * * *